US011342675B2

(12) United States Patent
Kobayashi et al.

(10) Patent No.: US 11,342,675 B2
(45) Date of Patent: May 24, 2022

(54) ANTENNA MODULE

(71) Applicant: HARADA INDUSTRY CO., LTD., Tokyo (JP)

(72) Inventors: Hidekazu Kobayashi, Tokyo (JP); Takeshi Sakano, Tokyo (JP)

(73) Assignee: HARADA INDUSTRY CO., LTD., Tokyo (JP)

( * ) Notice: Subject to any disclaimer, the term of this patent is extended or adjusted under 35 U.S.C. 154(b) by 0 days.

(21) Appl. No.: 17/039,491

(22) Filed: Sep. 30, 2020

(65) Prior Publication Data

US 2021/0098884 A1 Apr. 1, 2021

(30) Foreign Application Priority Data

Oct. 1, 2019 (JP) ..... JP2019-181264

(51) Int. Cl.

| | |
|---|---|
| ***H01Q 9/04*** | (2006.01) |
| ***H01Q 1/22*** | (2006.01) |
| ***H01Q 19/00*** | (2006.01) |
| ***H01Q 5/307*** | (2015.01) |
| ***H01Q 1/48*** | (2006.01) |

(52) U.S. Cl.

CPC ..... *H01Q 9/0414* (2013.01); *H01Q 1/2283* (2013.01); *H01Q 1/48* (2013.01); *H01Q 5/307* (2015.01); *H01Q 19/005* (2013.01)

(58) Field of Classification Search

CPC ..... H01Q 1/20; H01Q 1/22; H01Q 1/2283; H01Q 9/04; H01Q 9/0407; H01Q 9/0414; H01Q 19/005

See application file for complete search history.

(56) References Cited

U.S. PATENT DOCUMENTS

| | | | | |
|---|---|---|---|---|
| 7,046,203 | B2 * | 5/2006 | Yuanzhu | H01Q 9/0407 343/846 |
| 10,515,654 | B2 * | 12/2019 | Nongpiur | G10L 25/51 |
| 2008/0036665 | A1 * | 2/2008 | Schadler | H01Q 9/0435 343/700 MS |
| 2019/0280386 | A1 * | 9/2019 | Kowaita | H01Q 1/48 |
| 2019/0302271 | A1 * | 10/2019 | Panther | G01S 19/35 |
| 2021/0036426 | A1 * | 2/2021 | Iino | H01Q 9/0414 |
| 2021/0075099 | A1 * | 3/2021 | Soga | H04W 88/085 |
| 2021/0098884 | A1 * | 4/2021 | Kobayashi | H01Q 19/005 |
| 2021/0111491 | A1 * | 4/2021 | Hasegawa | H01Q 9/0414 |

FOREIGN PATENT DOCUMENTS

| | | |
|---|---|---|
| JP | 2018-121143 A | 8/2018 |
| JP | 2019-016930 A | 1/2019 |

* cited by examiner

*Primary Examiner* — Jason Crawford

(74) *Attorney, Agent, or Firm* — Global IP Counselors, LLP

(57) ABSTRACT

An antenna module configured to receive a radio communication signal includes: a circuit board on which a signal processing circuit is placed; a patch antenna stacked on the circuit board; a parasitic element disposed above the patch antenna, having held portions having at least two sides opposed to each other, and configured to improve elevation angle reception characteristics of the patch antenna; an integrated resin holder supporting the circuit board and the parasitic element, having at least a pair of parasitic element locking pawls that sandwich and support the two sides of the held portions of the parasitic element from both sides such that the distance between the patch antenna and the parasitic element is kept constant.

15 Claims, 4 Drawing Sheets

ANTENNA MODULE

CROSS-REFERENCE TO RELATED APPLICATIONS

This application claims priority to Japanese Patent Application No. 2019-181264 filed on Oct. 1, 2019.

BACKGROUND

Technical Field

The present invention generally relates to an antenna module, and more particularly to an integrated antenna module capable of receiving a radio communication signal.

Description of the Related Art

There is known an antenna module having a modularized structure including a circuit board, an antenna, and the like as one unit to enable reception of a radio communication signal. As a typical antenna module, a patch antenna for receiving a circularly polarized signal that is constructed using a ceramic or dielectric substrate, is known. Such a modularized patch antenna is accommodated in a low-profile antenna installed on a vehicle roof so as to realize communication such as GNSS (Global Navigation Satellite System) and SDARS (Satellite Digital Audio Radio Service). The low-profile antenna device includes, in addition to the patch antenna, many antennas required to realize other communications for, such as a radio, a television, and a mobile phone.

Further, there is known an antenna device in which a parasitic element is disposed on a patch antenna for the purpose of improving the gain of the patch antenna (Japanese Patent Application Kokai Publication No. 2019-016930 referred to hereinafter as Patent Document 1). Specifically, in the antenna device disclosed in Patent Document 1, the patch antenna is fixed on a base, and the parasitic element is fixed to an inner case covering the base, and the parasitic element functions as a waveguide in a state where the antenna device is in an assembled state.

Furthermore, there is known a composite antenna device provided with a capacitive antenna having a top load portion and a patch antenna, in which the top load portion is used as a waveguide of the patch antenna (Japanese Patent Application Kokai Publication No. 2018-121143 referred to hereinafter as Patent Document 2). In the composite antenna device disclosed in Patent Document 2, the top load portion is, for example, thermally welded to a columnar holding portion fixed to a base to be held at a predetermined height position from the patch antenna. The top load portion is used as a capacitive antenna and is thus connected with a power feed line. Thus, the top load portion functioning also as a waveguide is held above the patch antenna by the holding portion and power feed line.

However, in the antenna device disclosed in Patent Document 1, the parasitic element is fixed to the inner case, so that the antenna reception performance may vary due to displacement during assembly between the inner case and the base. Further, when this antenna device is applied to a vehicle antenna device, displacement may occur due to vibration of the vehicle, which may cause variation in antenna reception performance. Thus, it is necessary to avoid displacement during assembly, which impairs assemblability during manufacturing of the antenna device.

In the composite antenna device disclosed in Patent Document 2, the top load portion is held by one columnar holding portion and a power feed line, so that when this antenna device is applied to a vehicle antenna device, the position of the top load portion with respect to the patch antenna may be displaced due to vibration of the vehicle, which may cause variation in antenna reception performance. Further, the top load portion is thermally welded to the holding portion for position holding, which impairs assemblability during manufacturing of the antenna device.

SUMMARY

In view of the above situation, the present disclosure has been made and the object thereof is to provide an antenna module in which variation in antenna reception performance is prevented, and excellent assemblability during manufacturing is ensured by modularization.

In order to achieve the above object of the present disclosure, an antenna module can include: a circuit board on which a signal processing circuit is placed; a patch antenna stacked on the circuit board; a parasitic element disposed above the patch antenna, having held portions having at least two sides opposed to each other, and configured to improve elevation angle reception characteristics of the patch antenna; and an integrated resin holder for supporting the circuit board and the parasitic element, having at least a pair of parasitic element locking pawls that sandwich and support the two sides of the held portions of the parasitic element from both sides such that the distance between the patch antenna and parasitic element is kept constant.

The held portions of the parasitic element can be parasitic element locking concaves that the pair of parasitic element locking pawls lock.

At least one of the pair of parasitic element locking pawls that sandwich and support two sides opposed to each other of the parasitic element from both sides can include two side-by-side locking pawls, the parasitic element locking concaves can include side-by-side locking concaves that the side-by-side locking pawls lock, respectively, and each of the side-by-side locking concaves can have a right-trapezoidal concave having an opening width larger than a width of each of the side-by-side locking pawls and having an opening bottom width smaller than a width of each of the side-by-side locking pawls, and each right-angled portion of the right-trapezoidal concaves is positioned on a side close to each of the side-by-side locking concaves, respectively.

The patch antenna can be a plate-like air patch antenna.

The circuit board can have a ground conductor pattern, the patch antenna can include; a plate-like air patch antenna stacked on the circuit board and configured to receive signals in a first frequency band and a ceramic patch antenna fixed on the plate-like patch antenna and configured to receive signals in a second frequency band, the parasitic element is disposed above the ceramic patch antenna and configured to improve elevation angle reception characteristics of the ceramic patch antenna, and the parasitic element locking pawls of the integrated resin holder can sandwich and support the two sides of the held portions of the parasitic element from both sides such that the distance between the plate-like patch antenna and the parasitic element is kept constant.

The integrated resin holder can further have a plate support portion disposed between the plate-like air patch antenna and the circuit board so as to support the plate-like air patch antenna.

The plate support portion of the integrated resin holder can have a boss, and the plate-like air patch antenna can have a fixing hole into which the boss is inserted for thermal welding.

The patch antenna can include a first ceramic patch antenna stacked on the circuit board and configured to receive signals in a first frequency band and a second ceramic patch antenna fixed on the first ceramic patch antenna and configured to receive signals in a second frequency band, the parasitic element can be disposed above the second ceramic patch antenna and configured to improve elevation angle reception characteristics of the second ceramic patch antenna, and the parasitic element locking pawls of the integrated resin holder can sandwich and support the two sides of the held portions of the parasitic element from both sides such that the distance between the second ceramic patch antenna and the parasitic element is kept constant.

The integrated resin holder can further have circuit board locking pawls that extend toward the circuit board to hold the circuit board.

The integrated resin holder can further have a rib that extends toward the circuit board to hold the circuit board, and the circuit board can have a concave to which the rib is press-fit.

The circuit board locking pawls and the parasitic element locking pawls of the integrated resin holder can be disposed so as not to overlap each other in a plan view.

The antenna module according to the present disclosure is advantageous in that variation in antenna reception performance can be prevented and that excellent assemblability during manufacturing of an antenna device can be ensured by modularization.

DETAILED DESCRIPTION OF THE EMBODIMENTS

Figure 1:
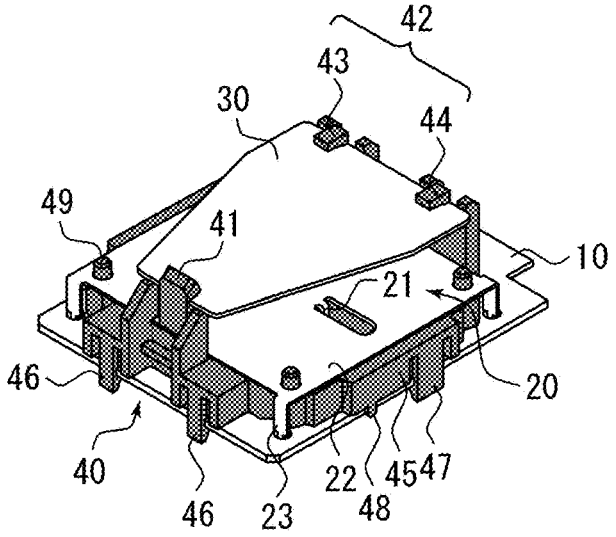
FIG. 1 is a schematic perspective view for explaining an antenna module according to one illustrated embodiment.
Figure 2:
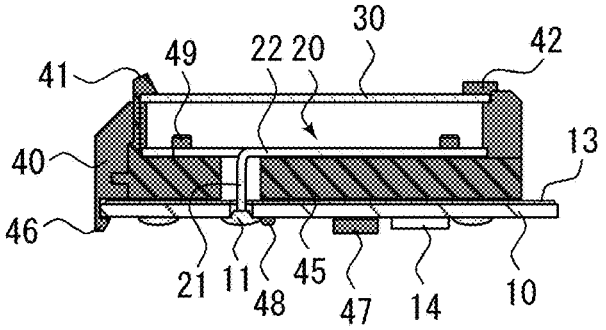
FIG. 2 is a schematic cross-sectional side view for explaining the antenna module according to the illustrated embodiment.

Preferred embodiments will be described below with reference to the accompanying drawings. FIG. 1 is a schematic perspective view for explaining an antenna module according to one illustrated embodiment. FIG. 2 is a schematic cross-sectional side view for explaining the antenna module according to the illustrated embodiment. In FIG. 2, the same reference numerals as those in FIG. 1 denote the same parts as those in FIG. 1. As illustrated, the antenna module mainly includes a circuit board 10, a patch antenna 20, a parasitic element 30, and an integrated resin holder 40. For example, the above components are integrated into one module and accommodated in a vehicle antenna device together with other antennas such as an AM/FM antenna and a mobile phone antenna.

The circuit board 10 is a member on which a signal processing circuit is placed. A circuit pattern and a ground conductor pattern 13 are formed by etching on the circuit board 10. An amplifier circuit 14 and the like can also be placed on the circuit board 10.

The patch antenna 20 is placed on the circuit board 10. The illustrated patch antenna 20 is a plate-like air patch antenna; however, the patch antenna according to the present invention is not limited to this, but can use a ceramic, a synthetic resin, a multilayer substrate or the like as a dielectric body. The patch antenna 20 is configured to receive signals in a first frequency band, for example. The first frequency band can be a frequency band for, for example, GNSS, which ranges from 1 GHz to 2 GHz; however, the frequency band supported by the patch antenna 20 of the antenna module according to the present invention is not limited to the above frequency band and can be another frequency band. The patch antenna 20 includes a power feed line 21 and a radiation element 22. The power feed line 21 is connected to a first power feed portion 11 of the circuit board 10.

Figure 3:
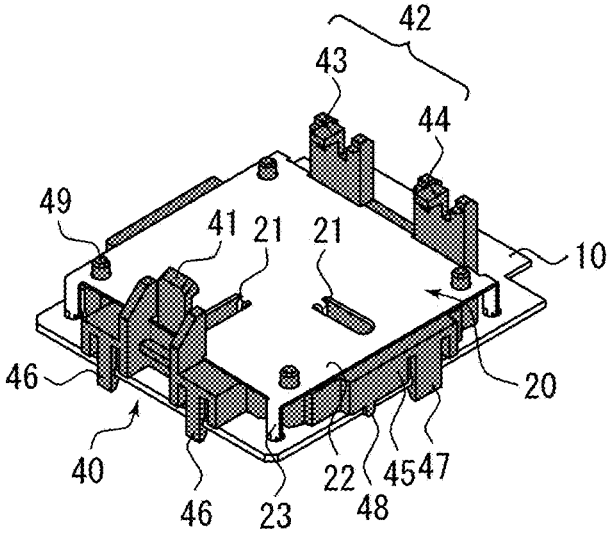
FIG. 3 is a schematic exploded perspective view for explaining the antenna module according to the illustrated embodiment.

The patch antenna 20 will be described in more detail using FIG. 3. FIG. 3 is a schematic exploded perspective view for explaining the antenna module according to the illustrated embodiment. In FIG. 3, the same reference numerals as those in FIG. 1 denote the same parts as those in FIG. 1. FIG. 3 illustrates a state before assembly of the parasitic element 30 to the antenna module for easy description of the patch antenna 20. The illustrated patch antenna 20 is a plate-like air patch antenna. The circuit board 10 has a ground conductor pattern 13 as illustrated in, e.g., FIG. 2. The ground conductor pattern 13 constitutes a micro-strip antenna together with the radiation element 22. The illustrated radiation element 22 is a quadrangular plate-like element and is disposed opposite to the circuit board 10 with a predetermined interval therefrom. The plate-like element is supported by a plurality of leg portions 23. The plurality of leg portions 23 can be formed such that when, for example, the radiation element 22 is cut out from a metal plate and subjected to sheet metal processing, portions projecting from four corners of the quadrangular plate-like element are bent. In the plate-like element having the leg portions 23 formed by bending protrusions extending from the four corners as in the illustrated example, the electrical length of the element is increased due to the presence of the leg portions 23. That is, in the top view, the bent leg portions 23 are positioned to the left and right of the plate-like element, so that the electrical length in the top/bottom direction is seen to be longer than that in the left/right direction. Thus, in this example, the plate-like element is not square, but rectangular with a length shorter in the top/bottom direction than that in the left/right direction. The leg portions 23 can not necessarily be formed by bending the plate-like element, but can be constituted by bar-like members separated from the plate-like element. The leg portions 23 can be fixed to the circuit board 10 by soldering or other means. In this case, the leg portions 23 are connected to the ground conductor pattern 13 through, for example, a capacitor. This is for compensating for insufficient capacity of the plate-like element. Alternatively, the capacity of the plate-like element can be compensated for by, for example, a meander-like wiring pattern. When the capacity is sufficient, the leg portions 23 can be fixed in a state being insulated from the ground conductor pattern 13 or the like. When the plate-like element can be supported by a means other than the leg portions 23, the leg portions 23 can be eliminated. Further, one of the leg portions 23 can be used as the first power feed line 21. In the illustrated patch antenna 20, the power feed line 21 is formed by bending a part of the radiation surface of the quadrangular plate-like element. Further, the illustrated patch antenna 20 is a dual feed patch antenna, and thus, two power feed lines 21 are formed. The present invention is however not limited to this; the patch antenna 20 can be a single feed patch antenna. Alternatively, the power feed line can be constituted by a separated bar-like member.

Figure 4:
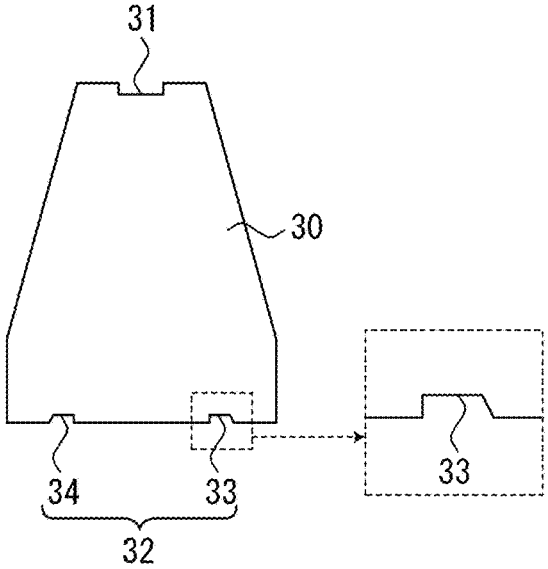
FIG. 4 is a schematic top view for explaining a parasitic element of the antenna module according to the illustrated embodiment.

Referring back to FIGS. 1 and 2, the parasitic element 30 will be described. The parasitic element 30 is disposed above the patch antenna 20. The parasitic element 30 has holding portions 31, 32 and configured to improve elevation angle reception characteristics of the patch antenna 20. The parasitic element 30 is a plate-like body as illustrated. Hereinafter, details of the parasitic element 30 will be described using FIG. 4. FIG. 4 is a schematic top view for explaining the parasitic element of the antenna module according to the illustrated embodiment. In FIG. 4, the same reference numerals as those in FIG. 1 denote the same parts as those in FIG. 1. When the antenna module according to the present disclosure is applied to, for example, a so-called shark-fin shaped low-profile antenna device, the upward direction in FIG. 4 corresponds to a vehicle travel direction and to the tip side of the shark-fin antenna. The parasitic element 30 of the antenna module according to the present disclosure has held portions 31, 32 having at least two sides opposed to each other. For example, the parasitic element 30 has a hexagonal plate-like body as illustrated. Specifically, the held portions 31, 32 of the parasitic element 30 are formed in the opposing parallel upper and lower sides. In the example of FIG. 4, the parasitic element 30 has a hexagonal shape having two opposing left and right sides, a lower side perpendicular to the two sides, and an upper side shorter than the lower side and parallel to the lower side. By forming the held portions 31, 32 in the opposing parallel upper and lower sides, the parasitic element 30 can be sandwiched and supported by the integrated resin holder 40 to be described later from both sides. The held portions 31, 32 of the parasitic element 30 are configured as parasitic element locking concaves that parasitic element locking pawls 41, 42 of the integrated resin holder 40 lock. That is, the bottom sides of the parasitic element locking concaves of the held portions are the two opposing parallel sides. The presence of the parasitic element locking concaves of the held portions 31, 32 allows the position of the parasitic element 30 with respect to the patch antenna 20 to be accurately fixed. Details of the parasitic element locking concaves of the held portions 31, 32 will be described later. In the antenna module according to the present disclosure, the shape of the parasitic element 30 is not limited to a hexagon and can be, for example, a trapezoid. Specifically, the trapezoid can be a quadrangle having the upper side shorter than the lower side and parallel to the lower side.

Referring again to FIGS. 1 to 3, the integrated resin holder 40 will be described. The integrated resin holder 40 is a member for supporting the circuit board 10 and the parasitic element 30. The integrated resin holder 40 has at least a pair of parasitic element locking pawls 41, 42. The parasitic element locking pawls 41, 42 sandwich and support the two sides of the held portions 31, 32 of the parasitic element 30 from both sides such that the distance between the patch antenna 20 and the parasitic element 30 is kept constant. The integrated resin holder 40 is made of insulating resin. The parasitic element locking pawls 41, 42 each pinch the front and back surfaces of the parasitic element 30 and lock them so as to keep the position of the parasitic element 30 in the height direction constant.

As illustrated, when a plate-like air patch antenna is used as the patch antenna 20, the integrated resin holder 40 can further have a plate support portion 45 that is disposed between the plate-like air patch antenna and the circuit board 10 and supports the plate-like air patch antenna. That is, the integrated resin holder 40 can also be configured to support the radiation element 22 of the plate-like air patch antenna. The use of the plate support portion 45 can prevent the radiation element 22 and leg portions 23 of the patch antenna 20 from being bent due to vibration or the like. Further, bosses 49 protrude from the plate support portion 45 of the integrated resin holder 40. The bosses 49 are inserted into fixing holes formed in the patch antenna 20 for thermal welding, whereby the patch antenna 20 is fixed to the integrated resin holder 40. Alternatively, the patch antenna 20 can be fixed to the integrated resin holder 40 by means of screws. The plate support portion 45 has a through hole through which the power feed line 21 passes. The integrated resin holder 40 has the plate support portion 45 as a center component and further has the parasitic element locking pawls 41, 42 and the circuit board locking pawls 46, 47 on the upper and lower sides of the plate support portion 45, respectively.

The parasitic element locking pawls 41, 42 extend from the plate support portion 45 toward the parasitic element 30 to hold the parasitic element 30. The parasitic element locking pawls 41, 42 pinch and lock the held portions 31, 32 formed in the upper and lower sides of the parasitic element 30 having, e.g., a hexagonal shape as illustrated in FIG. 4. The held portions 31, 32 of the parasitic element 30 are configured as the parasitic element locking concaves that the parasitic element locking pawls 41, 42 lock. That is, the parasitic element 30 has concaves as the held portions at positions corresponding to the parasitic element locking pawls 41, 42. In the illustrated example, the parasitic element locking pawl 42, which is one of the parasitic element locking pawls that sandwich and support the held portions 31, 32 having two opposing parallel sides of the parasitic element 30 from both sides, includes two side-by-side locking pawls 43, 44. Correspondingly, the held portion 32 of the parasitic element 30 includes side-by-side locking concaves 33, 34. The side-by-side locking concaves 33, 34 are locked by the side-by-side locking pawls 43, 44, respectively. The side-by-side locking concaves 33, 34 each preferably have a right-trapezoidal concave having an opening width larger than the width of each locking pawl and having an opening bottom width smaller than the width of each locking pawl. Further, the right-angled portion of each of the right-trapezoidal concaves is preferably positioned on a side close to each of the side-by-side locking concaves 33, 34, respectively. The oblique side is preferably positioned on a side far from each of the side-by-side locking concaves 33, 34, respectively. More specifically, the right-angled portion of the locking concave 33 is positioned at the corner close to the locking concave 34, and the right-angled portion of the locking concave 34 is positioned at the corner close to the locking concave 33. Thus, when the parasitic element 30 is locked by the parasitic element locking pawls 41, 42 (43, 44), the parasitic element locking pawls 41, 42 (43, 44) are press-fit to the locking concaves of the held portions 31, 32 (33, 34), whereby the parasitic element 30 is fixed to the integrated resin holder 40 with the horizontal movement restricted.

Figure 5:
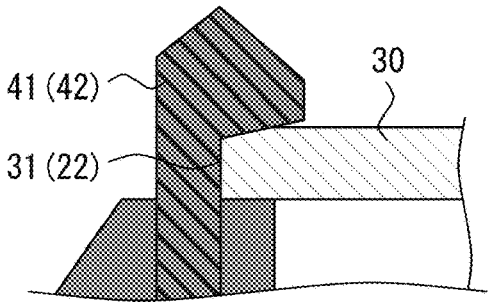
FIG. 5 is a schematic enlarged cross-sectional side view for explaining a parasitic element locking pawl of the antenna module according to the illustrated embodiment.

Each of the contact points between the parasitic element locking pawls 41, 42 and the held portions 31, 32 of the parasitic element 30 is designed as follows. FIG. 5 is a schematic enlarged cross-sectional side view for explaining the parasitic element locking pawl of the antenna module according to the illustrated embodiment. In FIG. 5, the same reference numerals as those in FIG. 1 denote the same parts as those in FIG. 1. As illustrated in FIG. 5, the parasitic element locking pawl 41 (42) is designed so as to hold the corner of the held portion 31 (32) of the parasitic element 30 with the slope of the pawl. When the parasitic element 30 is locked by the parasitic element locking pawl 41 (42), the parasitic element locking pawl 41 (42) is press-fit to the locking concave of the held portion 31 (32), whereby the parasitic element 30 is fixed to the integrated resin holder 40 with the vertical movement restricted. That is, the parasitic element 30 is fixed by the oblique sides of the side-by-side locking concaves 33, 34 with the horizontal movement restricted and fixed by the slopes of the parasitic element locking pawls 41, 42 with the vertical movement restricted. Thus, when the antenna module according to the present disclosure is applied to a vehicle antenna device, it is possible to prevent the parasitic element from rattling due to vibration of the vehicle.

Figure 6:
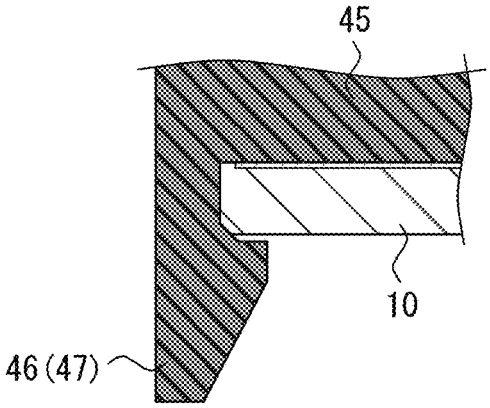
FIG. 6 is a schematic enlarged cross-sectional side view for explaining a circuit board locking pawl of the antenna module according to the illustrated embodiment.
Figure 7:
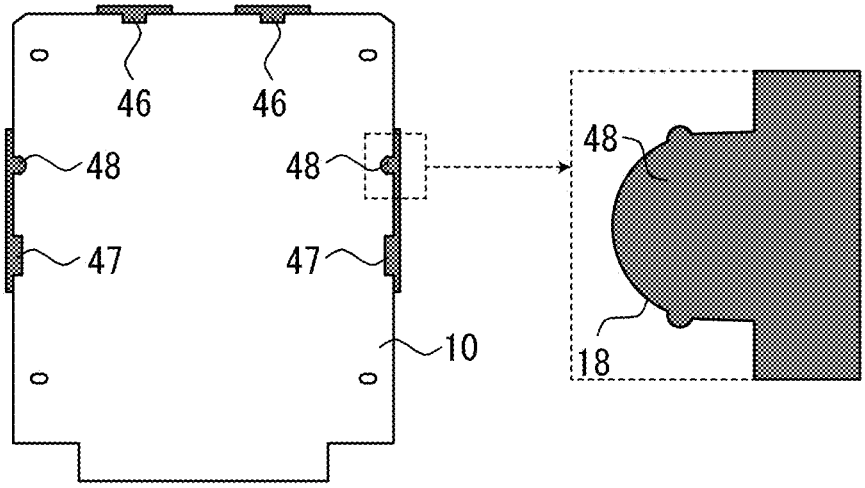
FIG. 7 is a schematic bottom view for explaining the circuit board locking pawl of the antenna module according to the illustrated embodiment.

The circuit board locking pawls 46, 47 extend from the plate support portion 45 toward the circuit board 10 to hold the circuit board 10. Details of the circuit board locking pawls will be described using FIGS. 6 and 7. FIG. 6 is a schematic enlarged cross-sectional side view for explaining the circuit board locking pawl of the antenna module according to the illustrated embodiment. FIG. 7 is a schematic bottom view for explaining the circuit board locking pawl of the antenna module according to the illustrated embodiment. In FIGS. 6 and 7, the same reference numerals as those in FIG. 1 denote the same portions as those in FIG. 1. The integrated resin holder 40 has a pair of circuit board locking pawls 47 that lock at least two sides of the circuit board 10 having, e.g., a rectangular shape so as to sandwich the circuit board 10. Further, the integrated resin holder 40 has a circuit board locking pawl 46 that locks another side. The circuit board locking pawl 46 (47) is designed so as to hold the corner of the side surface of the circuit board 10 with the inner slope of the locking pawl, as illustrated in FIG. 6. With this configuration, when the circuit board locking pawl 46 (47) locks the circuit board 10, the circuit board 10 is fixed so as to be pressed against the integrated resin holder 40 side (plate support portion 45 side). Thus, when the antenna module according to the present disclosure is applied to a vehicle antenna device, it is possible to prevent the circuit board from rattling due to vibration of the vehicle.

Further, as illustrated in FIG. 7, the integrated resin holder 40 can have a rib 48 that extends toward the inside of the circuit board 10 to hold the circuit board 10. The circuit board 10 has concaves at positions corresponding to the circuit board locking pawls 46, 47 and ribs 48. The rib 48 is press-fit to a concave 18 for rib, formed in the circuit board 10. With this configuration, the circuit board 10 is fixed to the integrated resin holder 40 with both the vertical and horizontal movements restricted.

As can be seen from FIG. 3, in the integrated resin holder 40, the circuit board locking pawls 46, 47 and the parasitic element locking pawls 41, 42 should preferably not overlap each other in a plan view. With this configuration, influence of bending caused upon locking of the locking pawls can be prevented from exerting on other locking pawls.

The antenna module configured as above according to the present disclosure is easy to assemble. That is, it is only necessary to lock or fix the circuit board 10, the patch antenna 20, and the parasitic element 30 with respect to the integrated resin holder 40. Further, the positional relationship between the patch antenna 20 and the parasitic element 30 is completely fixed, so that variation in antenna reception performance can be prevented. The antenna module assembled as above according to the present disclosure can be easily accommodated in a low-profile antenna device installed on a vehicle roof, thus ensuring excellent assemblability during manufacturing.

Although a plate-like air patch antenna is used as the patch antenna 20 in the illustrated example, the present invention is not limited to this. That is, a ceramic patch antenna can be used as the patch antenna 20. The ceramic patch antenna uses ceramic as a dielectric body and has a radiation element and a ground conductor pattern on the front and back surfaces, respectively, to constitute a microstrip antenna. In this case, the ceramic patch antenna is directly fixed to the circuit board 10, and the integrated resin holder 40 has, for example, a guide member that surrounds the side surfaces of the ceramic patch antenna so as to define the position of the ceramic patch antenna. The integrated resin holder 40 has such a guide member as a center component and further has the parasitic element locking pawls 41, 42 and circuit board locking pawls 46, 47 on the upper and lower sides of the guide member. In place of the ceramic, the patch antenna can use a synthetic resin, a multilayer substrate or the like as a dielectric body.

Figure 8:
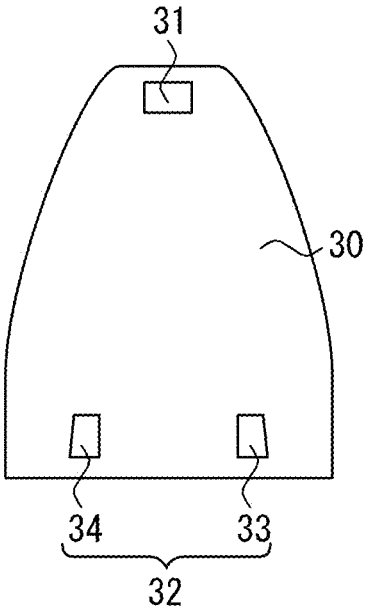
FIG. 8 is a schematic top view for explaining a modification of held portions of the parasitic element of the antenna module according to the illustrated embodiment.

Further, although the parasitic element 30 illustrated in FIG. 4 has a hexagonal shape, the present invention is not limited to this. The parasitic element 30 only needs to have the held portions 31, 32 having at least two sides opposed to each other. Thus, the parasitic element 30 itself may not necessarily have two sides opposed and parallel to each other. Hereinafter, a modification of the held portions of the parasitic element will be described using FIG. 8. FIG. 8 is a schematic top view for explaining a modification of the held portions of the parasitic element of the antenna module according to the illustrated embodiment. In FIG. 8, the same reference numerals as those in FIG. 1 denote the same parts as those in FIG. 1. As illustrated, the held portions 31, 32 can be holes formed in the parasitic element 30. One side of the hole of the held portion 31 and one side of the hole of the held portion 32 are opposed and parallel to each other. Thus, the held portions 31, 32 of the parasitic element 30 can be provided by forming holes as the parasitic element locking concaves. When the held portions have two sides opposed to each other, the two sides may not necessarily be parallel to each other.

Figure 9:
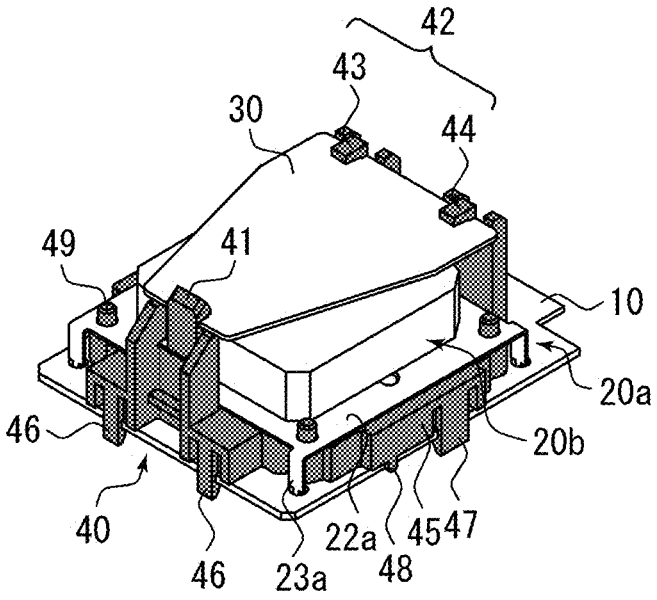
FIG. 9 is a schematic perspective view for explaining an example in which the antenna module according to the illustrated embodiment is configured as a stacked patch antenna.
Figure 10:
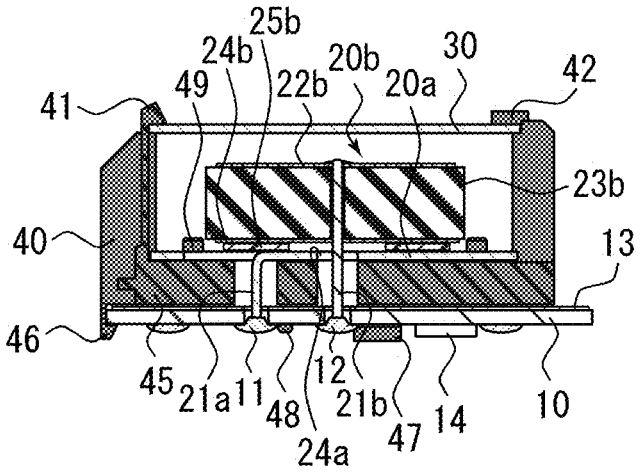
FIG. 10 is a schematic cross-sectional side view for explaining an example in which the antenna module according to the illustrated embodiment is configured as a stacked patch antenna.

The following describes a case where the antenna module according to the present disclosure is configured as a stacked patch antenna. FIG. 9 is a schematic perspective view for explaining an example in which the antenna module according to the illustrated embodiment is configured as a stacked patch antenna. FIG. 10 is a schematic cross-sectional side view for explaining an example in which the antenna module according to the illustrated embodiment is configured as a stacked patch antenna. In FIGS. 9 and 10, the same reference numerals as those in FIG. 1 denote the same parts as those in FIG. 1. The antenna module according to the present disclosure illustrated in FIGS. 9 and 10 mainly includes the circuit board 10, a first patch antenna 20*a*, a second patch antenna 20*b*, the parasitic element 30, and the integrated resin holder 40. In the illustrated stacked patch antenna, the first patch antenna 20*a* is a plate-like air patch antenna, and the second patch antenna 20*b* is a ceramic patch antenna. For example, the above components are integrated into one module and accommodated in a vehicle antenna device together with other antennas such as an AM/FM antenna and a mobile phone antenna.

The first patch antenna 20*a* is configured to receive signals in a first frequency band. The first frequency band can be a frequency band for, for example, GNSS, which ranges from 1 GHz to 2 GHz; however, the frequency band supported by the first patch antenna 20*a* of the antenna module according to the present invention is not limited to the above frequency band and can be another frequency band. The first patch antenna 20*a* is stacked on the circuit board 10. The first patch antenna 20*a* includes a first power feed line 21*a* and a first radiation element 22*a*. The first power feed line 21*a* is connected to the first power feed portion 11 of the circuit board 10. In the illustrated example, the first patch antenna 20*a* is a plate-like air patch antenna in which the first radiation element 22*a* is formed of a plate-like element. The circuit board 10 has, for example, the ground conductor pattern 13. The ground conductor pattern 13 constitutes a micro-strip antenna together with the first radiation element 22*a*. The illustrated first radiation element 22*a* is a quadrangular plate-like element and is disposed opposite to the circuit board 10 with a predetermined interval therefrom. The plate-like element is supported by a plurality of the leg portions 23*a*. The plurality of leg portions 23*a* can be formed such that when, for example, the first radiation element 22*a* is cut out from a metal plate and subjected to sheet metal processing, portions projecting from the four corners of the quadrangular plate-like element are bent. However, the first patch antenna 20*a* of the antenna module according to the present invention is not limited to this, but can use a ceramic, a synthetic resin, a multilayer substrate or the like as a dielectric body.

The configuration of the first patch antenna 20*a* is basically the same as that of the patch antenna 20 illustrated in FIGS. 1 to 3. Since the illustrated antenna module is configured as a stacked patch antenna, the plate-like element of the first patch antenna 20*a* has a through hole 24*a* through which a second power feed line 21*b* of the second patch antenna 20*b* to be described later passes. However, the present invention is not limited to this and, for example, the second power feed line 21*b* can be made to pass through a slit which is formed by cutting and bending a part of the radiation element upon formation of the first power feed line 21*a*.

Next, the second patch antenna 20*b* will be described. The second patch antenna 20*b* is configured to receive signals in a second frequency band higher than the above first frequency band. The second frequency band can be a frequency band for, for example, SDARS, which is 2.3 GHz; however, the frequency band supported by the second patch antenna 20*b* of the antenna module according to the present invention is not limited to the above frequency band and can be another frequency band which is higher than the first frequency band. The second patch antenna 20*b* is stacked on the first patch antenna 20*a*. The second patch antenna 20*b* includes a second power feed line 21*b* and a second radiation element 22*b*. The second power feed line 21*b* is connected to a second power feed portion 12 of the circuit board 10. That is, the second power feed line 21*b* is longer than the first power feed line 21*a* and is connected to the second power feed portion 12 of the circuit board 10 through the first radiation element 22*a*. In this case, the second power feed line 21*b* is made to pass through the through hole 24*a* formed in the first radiation element 22*a* of the first patch antenna 20*a* so as to be connected to the second power feed portion 12. The second radiation element 22*b* is smaller in size than the first radiation element 22*a*. In the example illustrated in FIGS. 9 and 10, the second patch antenna 20*b* is a ceramic patch antenna using a ceramic 23*b* as a dielectric body; however, the second patch antenna 20*b* of the antenna module according to the present invention is not limited to this, but can use a synthetic resin, a multilayer substrate or the like as a dielectric body. In the illustrated example, a ground conductor pattern 24*b* formed on the back surface of the ceramic 23*b* constitutes a micro-strip antenna together with the second radiation element 22*b*. Further, the second patch antenna 20*b* can be fixed onto the first patch antenna 20*a* with, for example, a double-sided adhesive tape 25*b*. This allows the first radiation element 22*a* of the first patch antenna 20*a* and the ground conductor pattern 24*b* to be electrically insulated from each other.

The second patch antenna 20*b* provided on the first patch antenna 20*a* receives signals in a higher frequency band. When a longer second power feed line 21*b* is used, antenna reception sensitivity characteristics of the second patch antenna 20*b* at middle to high elevation angles can be affected. Thus, in the antenna module according to the present disclosure, the following structure is adopted so as to improve the reception sensitivity characteristics.

That is, as illustrated in FIG. 9, in the antenna module according to the present disclosure, the parasitic element 30 is used so as to improve the elevation angle reception characteristics of the second patch antenna 20*b*. The parasitic element 30 is a plate-like element. The parasitic element 30 can be, for example, a conductive plate. The parasitic element 30 is disposed above the second patch antenna 20*b*. The parasitic element 30 has basically the same configuration as that described using FIG. 4 and the like.

The integrated resin holder 40 supports the plate-like air patch antenna, and the parasitic element locking pawls 41, 42 sandwich and support the two sides of the held portions of the parasitic element 30 from both sides such that the distance between the plate-like patch antenna and the parasitic element 30 is kept constant. The integrated resin holder 40 also has basically the same configuration as that described using FIGS. 1 to 3.

As described above, even when the antenna module according to the present disclosure is configured as a stacked patch antenna, the distance and positional relationship between the parasitic element 30 and the second patch antenna 20*b* are always kept constant, making it possible to stabilize antenna performance and to ensure excellent assemblability during manufacturing.

The patch antenna illustrated in FIGS. 9 and 10 is configured as the stacked patch antenna including the first patch antenna as a plate-like air patch antenna and the second patch antenna as a ceramic patch antenna. However, the antenna module according to the present invention is not limited to this. For example, both the first and second patch antennas can be a ceramic patch antenna. That is, it is only necessary to constitute the following stacked patch antenna using the first and second ceramic patch antennas: the first ceramic patch antenna is stacked on the circuit board and configured to receive signals in the first frequency band; the second ceramic patch antenna is fixed on the first ceramic patch antenna and configured to receive signals in the second frequency band; the parasitic element is disposed above the second ceramic patch antenna and configured to improve the elevation angle reception characteristics of the second ceramic patch antenna; and the parasitic element locking pawls of the integrated resin holder sandwich and support the two sides of the held portions of the parasitic element from both sides such that the distance between the second ceramic patch antenna and the parasitic element is kept constant.

The antenna module according to the present invention is not limited to the above illustrated examples but may be variously modified without departing from the scope of the present invention.

What is claimed is:

1. An antenna module configured to receive a radio communication signal, the antenna module comprising:

a circuit board on which a signal processing circuit is placed;

a patch antenna stacked on the circuit board;

a parasitic element disposed above the patch antenna, having held portions having at least two sides opposed to each other, and configured to improve elevation angle reception characteristics of the patch antenna; and an integrated resin holder for supporting the circuit board and the parasitic element, having at least a pair of parasitic element locking pawls that sandwich and support the two sides of the held portions of the parasitic element from both sides and pinch front and back surfaces of the parasitic element such that the distance between the patch antenna and the parasitic element is kept constant.

2. The antenna module according to claim 1, wherein the held portions of the parasitic element are parasitic element locking concaves that the pair of parasitic element locking pawls lock.

3. The antenna module according to claim 2, wherein at least one of the pair of parasitic element locking pawls that sandwich and support the two sides opposed to each other of the parasitic element from both sides includes two side-by-side locking pawls, the parasitic element locking concaves include side-by-side locking concaves that the side-by-side locking pawls lock, respectively, and each of the side-by-side locking concaves has a right-trapezoidal concave having an opening width larger than a width of each of the side-by-side locking pawls and having an opening bottom width smaller than a width of each of the side-by-side locking pawls, and each right-angled portion of the right-trapezoidal concaves is positioned on a side close to each of the side-by-side locking concaves, respectively.

4. The antenna module according to claim 1, wherein the patch antenna is a plate-like air patch antenna.

5. The antenna module according to claim 4, wherein the integrated resin holder further has a plate support portion disposed between the plate-like air patch antenna and the circuit board so as to support the plate-like air patch antenna.

6. The antenna module according to claim 5, wherein the plate support portion of the integrated resin holder has a boss, and the plate-like air patch antenna has a fixing hole into which the boss is inserted for thermal welding.

7. The antenna module according to claim 1, wherein the circuit board has a ground conductor pattern, the patch antenna includes; a plate-like air patch antenna stacked on the circuit board and configured to receive signals in a first frequency band; and a ceramic patch antenna fixed on the plate-like patch antenna and configured to receive signals in a second frequency band, the parasitic element is disposed above the ceramic patch antenna and configured to improve elevation angle reception characteristics of the ceramic patch antenna, and the parasitic element locking pawls of the integrated resin holder sandwich and support the two sides of the held portions of the parasitic element from both sides such that the distance between the plate-like patch antenna and the parasitic element is kept constant.

8. The antenna module according to claim 1, wherein the patch antenna includes a first ceramic patch antenna stacked on the circuit board and configured to receive signals in a first frequency band and a second ceramic antenna fixed on the first ceramic patch antenna and configured to receive signals in a second frequency band, the parasitic element is disposed above the second ceramic patch antenna and configured to improve elevation angle reception characteristics of the second ceramic patch antenna, and the parasitic element locking pawls of the integrated resin holder sandwich and support the two sides of the held portions of the parasitic element from both sides such that the distance between the second ceramic patch antenna and the parasitic element is kept constant.

9. The antenna module according to claim 1, wherein the integrated resin holder further has circuit board locking pawls that extend toward the circuit board to hold the circuit board.

10. The antenna module according to claim 9, wherein the circuit board locking pawls and the parasitic element locking pawls of the integrated resin holder are disposed so as not to overlap each other in a plan view.

11. The antenna module according to claim 1, wherein the integrated resin holder further has a rib that extends toward the circuit board to hold the circuit board, and the circuit board has a concave to which the rib is press-fit.

12. An antenna module configured to receive a radio communication signal, the antenna module comprising:

a circuit board on which a signal processing circuit is placed;

a patch antenna stacked on the circuit board;

a parasitic element disposed above the patch antenna, having held portions having at least two sides opposed to each other, and configured to improve elevation angle reception characteristics of the patch antenna; and an integrated resin holder for supporting the circuit board and the parasitic element, having at least a pair of parasitic element locking pawls that sandwich and support the two sides of the held portions of the parasitic element from both sides such that the distance between the patch antenna and the parasitic element is kept constant, wherein the held portions of the parasitic element are parasitic element locking concaves that the pair of parasitic element locking pawls lock, at least one of the pair of parasitic element locking pawls that sandwich and support the two sides opposed to each other of the parasitic element from both sides includes two side-by-side locking pawls, the parasitic element locking concaves include side-by-side locking concaves that the side-by-side locking pawls lock, respectively, and each of the side-by-side locking concaves has a right-trapezoidal concave having an opening width larger than a width of each of the side-by-side locking pawls and having an opening bottom width smaller than a width of each of the side-by-side locking pawls, and each right-angled portion of the right-trapezoidal concaves is positioned on a side close to each of the side-by-side locking concaves, respectively.

13. An antenna module configured to receive a radio communication signal, the antenna module comprising:

a circuit board on which a signal processing circuit is placed;

a patch antenna stacked on the circuit board;

a parasitic element disposed above the patch antenna, having held portions having at least two sides opposed to each other, and configured to improve elevation angle reception characteristics of the patch antenna; and an integrated resin holder for supporting the circuit board and the parasitic element, having at least a pair of parasitic element locking pawls that sandwich and support the two sides of the held portions of the parasitic element from both sides such that the distance between the patch antenna and the parasitic element is kept constant, wherein the circuit board has a ground conductor pattern, the patch antenna includes; a plate-like air patch antenna stacked on the circuit board and configured to receive signals in a first frequency band; and a ceramic patch antenna fixed on the plate-like patch antenna and configured to receive signals in a second frequency band, the parasitic element is disposed above the ceramic patch antenna and configured to improve elevation angle reception characteristics of the ceramic patch antenna, and the parasitic element locking pawls of the integrated resin holder sandwich and support the two sides of the held portions of the parasitic element from both sides such that the distance between the plate-like patch antenna and the parasitic element is kept constant.

14. An antenna module configured to receive a radio communication signal, the antenna module comprising:

a circuit board on which a signal processing circuit is placed;

a patch antenna stacked on the circuit board;

a parasitic element disposed above the patch antenna, having held portions having at least two sides opposed to each other, and configured to improve elevation angle reception characteristics of the patch antenna; and an integrated resin holder for supporting the circuit board and the parasitic element, having at least a pair of parasitic element locking pawls that sandwich and support the two sides of the held portions of the parasitic element from both sides such that the distance between the patch antenna and the parasitic element is kept constant, wherein the patch antenna is a plate-like air patch antenna, the integrated resin holder further has a plate support portion disposed between the plate-like air patch antenna and the circuit board so as to support the plate-like air patch antenna, the plate support portion of the integrated resin holder has a boss, and the plate-like air patch antenna has a fixing hole into which the boss is inserted for thermal welding.

15. An antenna module configured to receive a radio communication signal, the antenna module comprising:

a circuit board on which a signal processing circuit is placed;

a patch antenna stacked on the circuit board;

a parasitic element disposed above the patch antenna, having held portions having at least two sides opposed to each other, and configured to improve elevation angle reception characteristics of the patch antenna; and an integrated resin holder for supporting the circuit board and the parasitic element, having at least a pair of parasitic element locking pawls that sandwich and support the two sides of the held portions of the parasitic element from both sides such that the distance between the patch antenna and the parasitic element is kept constant, wherein the patch antenna includes a first ceramic patch antenna stacked on the circuit board and configured to receive signals in a first frequency band and a second ceramic antenna fixed on the first ceramic patch antenna and configured to receive signals in a second frequency band, the parasitic element is disposed above the second ceramic patch antenna and configured to improve elevation angle reception characteristics of the second ceramic patch antenna, and the parasitic element locking pawls of the integrated resin holder sandwich and support the two sides of the held portions of the parasitic element from both sides such that the distance between the second ceramic patch antenna and the parasitic element is kept constant.

* * * * *